United States Patent [19]

Simmons

[11] 4,375,758

[45] Mar. 8, 1983

[54] PORTABLE ICE TABLE

[76] Inventor: Jesse K. Simmons, 4030 Sleeth Rd., Milford, Mich. 48042

[21] Appl. No.: 301,500

[22] Filed: Sep. 14, 1981

[51] Int. Cl.[3] ..... F25D 3/08

[52] U.S. Cl. ..... 62/457; 62/459

[58] Field of Search ..... 62/258, 372, 440, 457, 62/459, 529

[56] References Cited

U.S. PATENT DOCUMENTS

| | | | |
|---|---|---|---|
| 767,321 | 8/1904 | Wheldon | 62/440 X |
| 891,659 | 6/1908 | Boeck | 62/459 X |
| 1,782,720 | 11/1930 | Franklin | 62/459 X |
| 2,527,571 | 10/1950 | Pownall | 62/459 X |
| 3,710,589 | 1/1973 | Brown et al. | 62/459 X |
| 4,265,095 | 5/1981 | McConachie | 62/457 X |
| 4,307,581 | 12/1981 | Reid | 62/457 |

*Primary Examiner*—Lloyd L. King

*Attorney, Agent, or Firm*—Reising, Ethington, Barnard, Perry & Brooks

[57] ABSTRACT

A portable ice table having a platform comprised of a light-weight material with an outer insulated surface and a removable insulating cover. The platform includes a handle, a recessed dry storage compartment and a recessed ice storage compartment separated from the dry storage compartment by a separating member. A threaded orifice is provided between the ice storage compartment and the side of the platform for storing and draining water from the ice table. The ice table further includes supporting members fixedly secured to the bottom of the platform for setting the platform on a table and also includes legs pivotably secured to the platform to support the platform above the ground or floor.

23 Claims, 6 Drawing Figures

PORTABLE ICE TABLE

BACKGROUND ART

This invention relates generally to ice tables, and is particularly concerned with a portable ice table of knock-down construction for serving and preserving food where the food must be kept cool.

It is often desirable to serve food by setting it on tables and allowing an individual to select the particular items of food and quantity desired. The serving of food in this manner has several advantages as it allows for several individuals to serve themselves at the same time, and as such is cost effective when compared with individual service by waitpersons.

DISCLOSURE OF THE INVENTION

An object of this invention is to provide an ice table for serving food which is compact, light-weight and portable and which has space for storing ice to refrigerate food and drinks served from the table.

In carrying out the foregoing, and other objects, an ice table according to the present invention includes a platform comprised of a light-weight hard organic plastic material having an outer insulating surface.

The platform has a handle for carrying and transporting the ice table when it is not in use.

The platform contains two recessed compartments, a recessed dry storage compartment and a recessed ice storage compartment separated by a fixed or manually removable separating member.

The recessed ice storage compartment has a first section for storing ice, a removable perforated ice supporting member and a second section. The first section is disposed above the second section with the perforated ice supporting member being disposed between the first and second sections.

The second section includes a threaded orifice which extends through the side of the platform for storing and draining water from the ice table. A valve may be disposed within the orifice to control the opening and closing of the orifice.

The ice table further includes legs which are pivotably secured to the platform and may be locked in place to support the platform above the floor or ground. The legs may be stored within the platform when not in use.

If it is desired not to use the legs, supporting members fixedly secured to the bottom of the platform are provided for setting the platform on a table.

The ice table also includes a removable insulating cover to maintain a cool temperature within the ice table.

In accordance with the invention, food is placed upon the ice in the first section of the ice storage compartment where it is kept cold while being served. A dry storage compartment is also provided for serving food which does not require chilling. The dry storage compartment is separated from the ice storage compartment by the separating member such that water from the melted ice in the ice storage compartment is prevented from entering the dry storage compartment.

As the ice stored in the first section of the ice storage compartment begins to melt, the water from the melted ice flows through the openings in the perforated ice supporting member away from the unmelted ice into the second section.

The bottom of the platform is sloped such that water flows away from the dry storage compartment towards the threaded orifice.

When the orifice is closed the water from the first section is stored in the second section. When the orifice is open, the water from the first section is drained from the ice table.

Other objects, advantages and features of the invention will become apparent from the following description taken in connection with the accompanying drawings.

BEST MODE FOR CARRYING OUT THE INVENTION

Figure 1:
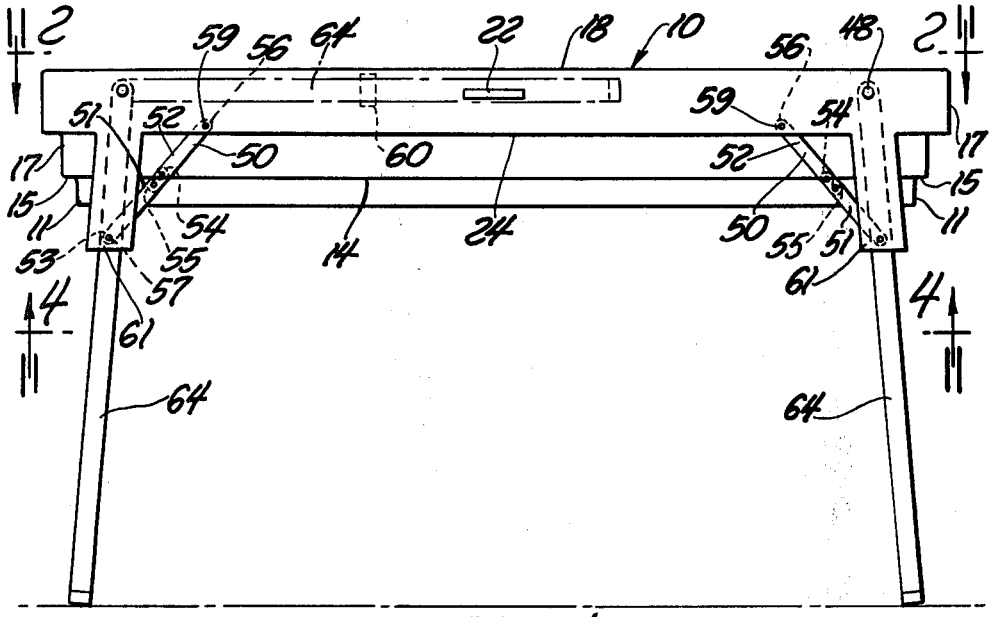
FIG. 1 is a side elevation view of the ice table.
Figure 2:
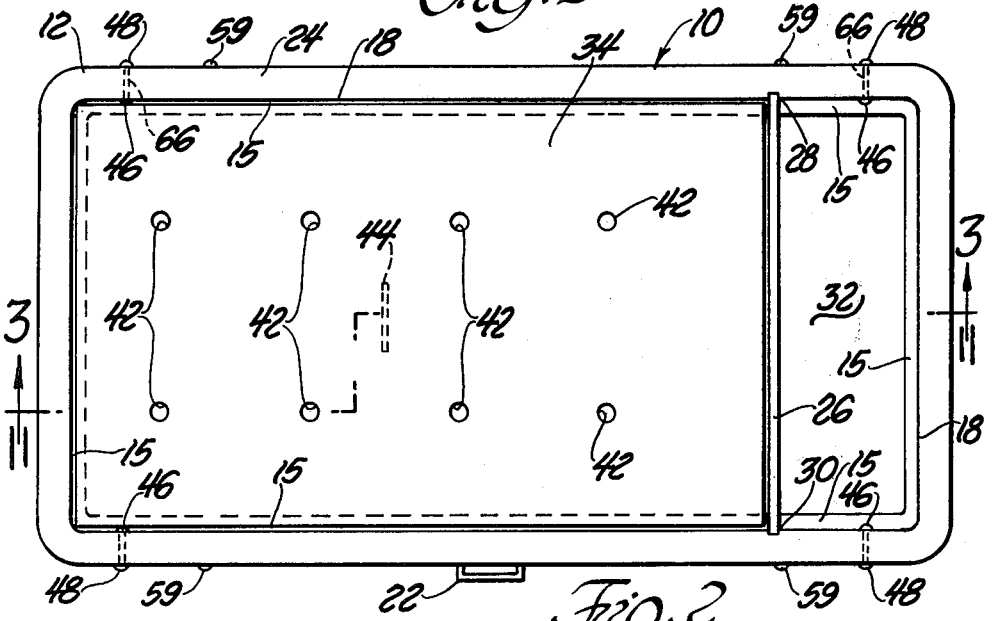
FIG. 2 is a top elevation view of the ice table taken along lines 2—2 of FIG. 1.
Figure 3:
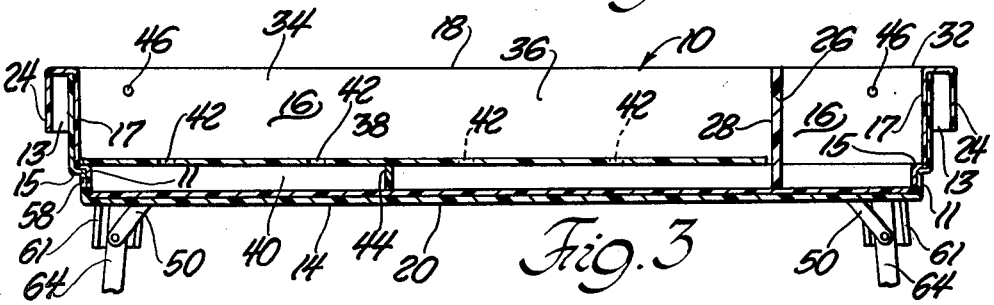
FIG. 3 is a sectional side elevation view of the ice table taken along lines 3—3 of FIG. 2.

Referring to the embodiments shown in FIGS. 1-3 of the drawings, a portable ice table, collectively indicated by reference numeral 10, is comprised of a platform, generally 12, as shown in FIG. 2, comprised of a light-weight hard organic plastic material such as polyethylene or polypropylene, and having an outer insulating surface 14 comprised of an expanded rigid polystyrene plastic such as Styrofoam.

Referring particularly to FIG. 3, the platform 12 includes a bottom 20, a lower vertical wall 11 extending upward from the bottom 20, a ledge 15 extending outward from the lower vertical wall 11, an upper vertical wall 17 extending upward from the ledge 15 and having an upper edge 18, and a skirt 24 depending from the upper edge 18 and spaced from the wall 11.

The platform 12 also includes an inner surface 16 extending from the bottom 20 to the upper edge 18 of the upper vertical wall 17.

The platform 12 has a handle 22 for carrrying and transporting the ice table 10.

The platform 12 further includes a manually removable separating member 26 extending vertically from the bottom 20 of the platform 12 to the upper edge 18 of the inner surface 16. The separating member 26 is fitted into and held in place by grooves 28 and 30 within the inner surface 16.

In an alternate embodiment, the separating member 26 is non-removable and fixedly secured to the inner surface 16.

The platform 12 also includes a recessed dry storage compartment 32 and a recessed ice storage compartment 34 as shown in FIG. 3. The dry storage compartment 32 is separated from the ice storage compartment 34 by the separating member 26.

The ice storage compartment 34 has a first section 36 for storing ice, a manually removable perforated ice supporting member 38 and a second section 40 as shown in FIG. 3. The first section 36 is disposed above the second section 40 with the perforated ice supporting member 38 being disposed between the first section 38 and the second section 40.

The perforated ice supporting member 38 includes openings 42 between the first section 36 and second section 40 as shown in FIG. 2. In its preferred construction it is comprised of a clear light-weight hard organic plastic material such as polyethylene or polypropylene which can be easily removed for cleaning.

The ice supporting member 38 is positioned and supported between the first section 36 and second section 40 by resting it on the ledge 15 and center positioning member 44. The center positioning member 44 is fixedly secured to the bottom 20 of the platform 12.

The second section 40 further includes a threaded orifice 58 which extends through the lower vertical wall 11 of the platform 12. A threaded valve, stopper, hose or other similar device may be disposed within the threaded orifice 58 to control the opening and closing of the orifice 58.

The ice table 10 includes legs 64 to support the platform 12 above the floor or ground. The legs 64 are pivotably secured to the platform 12 by pins 66 having opposite ends 46 and 48. Ends 46 are secured to the upper vertical wall 17 with ends 48 secured to the skirt 24. The legs 64 include supporting positions where they are positioned in a direction which is generally vertical and normal to the platform 12 as shown in FIGS. 1 and 3.

Locking members 50 provide vertical stability to the legs 14 and are secured between the legs 64 and the skirt 24. The locking members 50 include a first portion 51 having opposite ends 53 and 54, and a second portion 52, having opposite ends 55 and 56. Ends 53 are pivotably secured to the legs 64 with rivets 57, with ends 56 being pivotably secured to the skirt 24 with rivets 59. Ends 54 and 55 are pivotably connected to each other such that when the first and second portions 51 and 52 are disposed in a straight line between rivets 57 and 59 the legs 64 are locked in place and prevented from closing.

When the legs 54 are in their non-supporting position they are stored within the platform 12 in the space 13 between the skirt 24 and the upper vertical wall 17 where they are held in place by clips 60 secured beneath the skirt 24 as shown in phantom line in FIG. 1.

Figure 4:
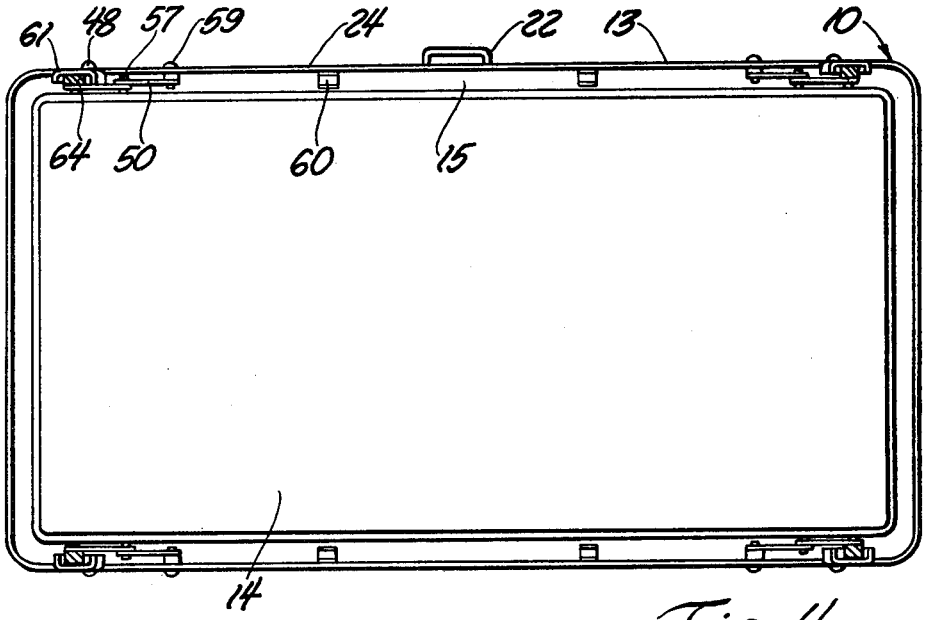
FIG. 4 is a bottom elevation view, partially in section, of the ice table taken along lines 4—4 of FIG. 3.

If the ice table 10 is to be used on a table top or like surface, the legs 64 are put in their non-supporting positions and the platform 12 is set on supporting members 61 which are fixedly secured to the platform 12 and which extend beneath the bottom 20 of the platform 12 as shown in FIGS. 1 and 4.

The supporting members 61 include grooves 63 which function as restraining members to hold and provide lateral stability to the legs 64 when in a supporting position as shown in FIG. 4.

Figure 5:
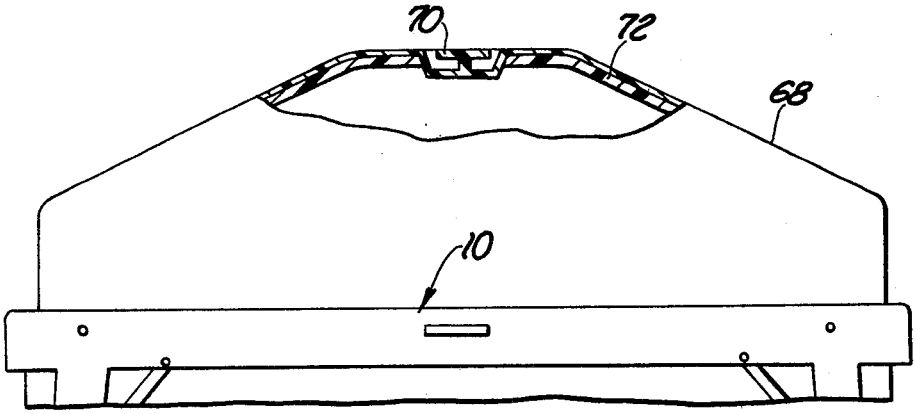
FIG. 5 is a sectional side elevation view of a cover for the ice table shown in FIGS. 1-4.

The ice table also includes a removable cover 68 also comprised of a hard organic plastic such as polyethylene or polypropylene including a handle 70 as shown in FIG. 5. The cover has an inner insulating surface 72 which is comprised of an expanded rigid polystyrene plastic such as Styrofoam.

Figure 6:
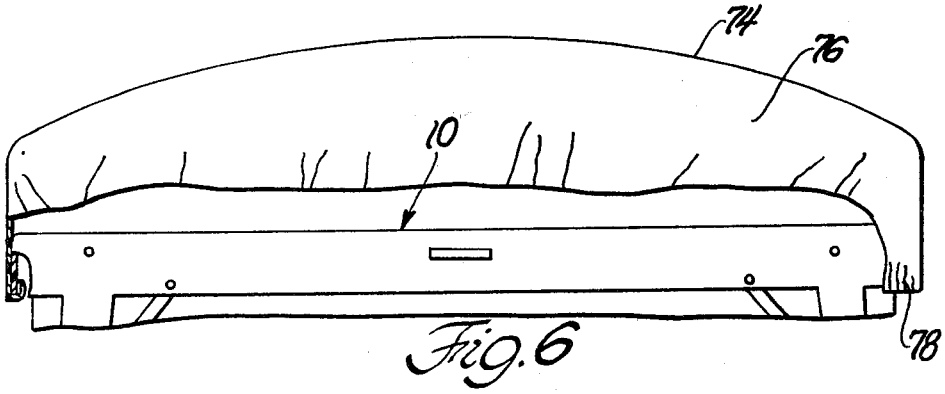
FIG. 6 is a side elevation view showing the cover in another embodiment for the ice table shown in FIGS. 1-4.

A cover 74 is shown in an alternate embodiment in FIG. 6. In this embodiment, the cover is comprised of a reflective fabric 76 which is held on the ice table by tension in the outer elastic band 78. The reflective fabric 76 reflects heat from the sun away from the ice table thereby slowing the melting of the ice.

The ice table 10 is used by placing the food to be kept chilled in the ice storage compartment 34 and food which is not required to be chilled in the dry storage compartment 32. Covers 68 and 74 may be placed over the platform 12 to keep the food cool and to slow down the melting of the ice. While the food is being served, the ice in the first section 36 of the ice storage compartment 34 begins to melt and water flows through the openings 42 of the ice supporting member 38 into the second section 40.

The bottom 20 of the platform 12 is sloped such that water flows away from dry storage compartment 32 towards the threaded orifice 58. When the orifice 58 is closed, water is stored in the second section 40. When the orifice 58 is open, water flows through the orifice 58 and is drained from the second section 40 away from the ice table 10.

The second section 40 can be drained continuously by leaving the orifice 58 open for the entire use of the table 10. Alternatively, water can be stored in the second section 40 by leaving the orifice 58 closed during the use of the ice table 10 and then draining the water from the second section 40 by opening the orifice 58 when the use of the ice table 10 is no longer required.

The rigid polystyrene plastic provided in the outer surface 14 of the platform 12 and inner surface 72 of the cover 68 maintains a cool temperature within the ice table 10 thereby slowing the melting process and preventing condensation.

While the embodiment herein described calls for the ice table to be comprised of a hard organic plastic material, it would be apparent to one skilled in the art that the ice table may be constructed of a suitable alternate material such as wood or a light-weight metal.

While specific modes for carrying out the invention have herein been described in detail, those familiar with the art to which this invention relates will recognize various alternative designs and embodiments for carrying out the invention as defined by the following claims.

What is claimed is:

1. A portable ice table comprising: a platform having an outer insulating surface, a bottom, an upstanding vertical wall extending upward from the bottom and having an inner surface with an upper edge, and a separating member with opposite ends secured to the inner surface and extending vertically from the bottom of the platform to the upper edge of the inner surface; said platform further including a handle, a recessed dry storage compartment and a recessed ice storage compartment separated from the dry storage compartment by the separating member and having a first section for storing ice, a manually removable perforated ice supporting member and a second section; said first section being disposed above the second section with the perforated ice supporting member being disposed between the first and second sections; said perforated ice supporting member including a plurality of openings between the first and second sections; said second section including at least one positioning member to position the ice supporting member between the first and second sections; said second section including means to store and drain water from the ice storage compartment; a plurality of supporting members adjustably secured to the platform to support the platform above a generally horizontal surface; a plurality of supporting members fixedly secured to the platform; and a removable insulating cover.

2. An ice table as in claim 1 wherein the platform is comprised of a light-weight hard organic plastic material.

3. An ice table as in claims 1 or 2 wherein the outer insulating surface of the platform is comprised of an expanded rigid polystyrene plastic.

4. An ice table as in claim 1 wherein the means to store and drain water from the ice storage compartment comprises an orifice in the second section extending through the platform and includes means for opening and closing the orifice.

5. An ice table as in claim 4 wherein the orifice is threaded.

6. An ice table as in claim 4 wherein the means for opening and closing the orifice comprises a valve having open and closed positions disposed within the orifice.

7. An ice table as in claim 1 wherein the melting of ice stored in the first section causes water to flow through the perforated ice supporting member into the second section.

8. An ice table as in claims 6 or 7 wherein the bottom of the platform is sloped such that water flows away from the dry storage compartment towards the orifice.

9. An ice table as in claim 8 wherein the water received from the melting of the ice in the first section is stored in the second section when the orifice is closed.

10. An ice table as in claim 8 wherein the water received from the melting of the ice in the first section is drained from the second section when the orifice is open.

11. An ice table as in claim 1 wherein the adjustably secured supporting members comprise legs pivotably secured to the platform including supporting and non-supporting positions.

12. An ice table as in claim 11 wherein the platform includes a skirt around its perimeter depending from the upper edge of the inner surface and spaced from the upstanding vertical wall.

13. An ice table as in claim 12 wherein the legs are stored within the platform in the space between the skirt and the upstanding vertical wall when in said non-supporting positions.

14. An ice table as in claim 12 wherein the legs are positioned in a direction which is generally vertical and normal to the platform and which may be temporarily and securely locked when in said supporting positions.

15. An ice table as in claims 13 or 14 wherein the fixedly secured supporting members support the platform above the generally horizontal surface when the adjustably secured supporting members are in a non-supporting position.

16. An ice table as in claim 1 wherein the cover is comprised of a light-weight hard organic plastic material having a handle and including an inner insulating surface.

17. An ice table as in claim 16 wherein the inner surface is comprised of an expanded rigid polystyrene plastic.

18. An ice table as in claim 1 wherein the cover is comprised of a light reflecting fabric with an elastic band secured to its edge.

19. An ice table as in claim 1 wherein the separating member is manually removable with opposite ends securable to the inner surface.

20. A portable ice table comprising: a platform comprised of a light-weight hard organic plastic material having an outer insulating surface comprised of an expanded rigid polystyrene plastic, a bottom, a lower upstanding vertical wall extending upward from the bottom, a ledge extending outward from the lower vertical wall, an upper vertical wall extending upward from the ledge and having an upper edge, and an inner surface including grooves extending from the bottom to the upper edge of the upper vertical wall; a manually removable separating member with opposite ends fitted into and held in place by the grooves within the inner surface and extending vertically from the bottom of the platform to the upper edge of the inner surface; said platform also including a skirt around its perimeter depending from the upper edge of the inner surface and spaced from the upstanding vertical wall, a handle, a recessed dry storage compartment and a recessed ice storage compartment separated from the dry storage compartment by the separating member and having a first section for storing ice, a manually removable perforated ice supporting member and a second section; said first section being disposed above the second section with the perforated ice supporting member being disposed between the first and second sections; said perforated ice supporting member including a plurality of openings between the first and second sections; said second section including at least one positioning member; said perforated ice supporting member resting on the ledge and positioning member thereby positioning it between the first and second sections; said second section further including means to store and drain water from the ice storage compartment comprising a threaded orifice in the second section extending through the platform and including a valve having open and closed positions for opening and closing the orifice; a plurality of adjustable supporting members comprising legs pivotably secured to the platform to support the platform above a generally horizontal surface and including supporting and non-supporting positions; said legs being stored within the platform in the space between the skirt and the upper vertical wall when in said non-supporting positions; said legs being positioned in a direction which is generally vertical and normal to said platform and which may be temporarily and securely locked when in said supporting positions; said platform having locking and restraining members to provide vertical and lateral stability to the legs when in said supporting positions; a plurality of supporting members fixedly secured to the platform to support the platform above a generally horizontal surface when the legs are in a non-supporting position; a removable insulating cover; and wherein the melting of ice stored in the first section causes water to flow through the perforated ice supporting member into the second section; said bottom of the platform being sloped such that water flows away from the dry storage compartment towards the threaded orifice; said water being stored in the second section when the orifice is closed and being drained from the second section when the orifice is open.

21. An ice table as in claim 20 wherein the cover is comprised of a light-weight hard organic plastic material having a handle and including an inner insulating surface.

22. An ice table as in claim 21 wherein the inner surface of the cover is comprised of an expanded rigid polystyrene plastic.

23. An ice table as in claim 20 wherein the cover is comprised of a light reflecting fabric with an elastic band secured to its edge.

* * * * *